US009347722B1

(12) United States Patent
Morris

(10) Patent No.: US 9,347,722 B1
(45) Date of Patent: May 24, 2016

(54) MAGAZINE LOADER

(71) Applicant: Charles Morris, North Platte, NE (US)

(72) Inventor: Charles Morris, North Platte, NE (US)

( * ) Notice: Subject to any disclaimer, the term of this patent is extended or adjusted under 35 U.S.C. 154(b) by 0 days.

(21) Appl. No.: 14/869,064

(22) Filed: Sep. 29, 2015

Related U.S. Application Data

(60) Provisional application No. 62/121,570, filed on Feb. 27, 2015.

(51) Int. Cl.
*F41A 9/83* (2006.01)

(52) U.S. Cl.
CPC ..... *F41A 9/83* (2013.01)

(58) Field of Classification Search
CPC ..... F41A 9/66; F41A 9/82; F41A 9/83; F41A 9/84
USPC ..... 42/87, 88
See application file for complete search history.

(56) References Cited

U.S. PATENT DOCUMENTS 4,574,511 A * 3/1986 Csongor ..... F41A 9/84 42/87
4,614,052 A 9/1986 Brown et al.
4,689,909 A * 9/1987 Howard ..... F41A 9/83 42/87
4,706,402 A * 11/1987 Csongor ..... F41A 9/84 42/87
4,719,715 A * 1/1988 Howard ..... F41A 9/83 42/87
4,888,902 A 12/1989 Knowles
5,129,173 A * 7/1992 Kuykendall ..... F41A 9/83 42/87
5,249,386 A * 10/1993 Switzer ..... F41A 9/83 42/87
5,355,606 A * 10/1994 Origoni ..... F41A 9/83 42/87
7,637,048 B2 12/2009 Tal et al.
8,650,792 B1 2/2014 Overmars
2014/0033592 A1 2/2014 Fiorucci

* cited by examiner

*Primary Examiner* — Reginald Tillman, Jr.
(74) *Attorney, Agent, or Firm* — Daniel Boudwin; Global Intellectual Property Agency, LLC

(57) ABSTRACT

A magazine loader for a firearm is provided. The magazine loader includes a base having a lip that is configured to removably engage a magazine in an upstanding position thereon. The base further includes a hydraulic shaft having a first end and a second end, wherein the first end is affixed to the base. The second end includes a depressible platform and a projection configured to load an unloaded cartridge placed above an opening of a magazine. The depressible platform is configured to be hand actuated in relation to the hydraulic shaft to apply downward pressure on the unloaded cartridge with the projection. In this way, the cartridge can be forced downwardly and loaded into the magazine. The depressible platform and projection automatically return to the resting position to allow for additional cartridges to be loaded.

6 Claims, 3 Drawing Sheets

MAGAZINE LOADER

CROSS REFERENCE TO RELATED APPLICATION

This application claims the benefit of U.S. Provisional Application No. 62/121,570 filed on Feb. 27, 2015. The above identified patent application is herein incorporated by reference in its entirety to provide continuity of disclosure.

FIELD OF THE INVENTION

The present invention relates to firearm accessories. Specifically, the present invention relates to a magazine loader that allows a user to facilitate loading a plurality of cartridges into a magazine.

BACKGROUND OF THE INVENTION

A magazine is an ammunition storage and feeding device within or attached to a firearm. These magazine are usually detachable for firearms such as pistols. Generally, the primary function of a magazine is to move cartridges stored within the magazine into a position where they can be loaded into the chamber by the action of the firearm.

Even for experts, loading cartridges into a magazine can be a slow and laborious process, and some people have difficulty learning to hand load a magazine with cartridges. Especially when wearing gloves or in cold weather, loading the cartridges into the magazine can take significant time. In other circumstances, quickly loading a magazine with cartridges is critical, such as when a hunter needs to reload the magazine. Therefore, there exists a need for a device that is adapted to allow a user to quickly load cartridges into a magazine.

Devices have been disclosed in the prior art that relate to magazine loaders. These include devices that have been patented and published in patent application publications. Some devices provide a loader having a handle and a pair of spaced apart, outwardly extending prongs. Other devices provide a loader that can load an entire magazine by pulling the magazine's external follower in a downward motion. However, these devices do not disclose a hand actuated hydraulic shaft that applies downward pressure to allow a user to avoid applying downward pressure to the magazine directly.

The present invention provides a magazine loader having a base configured to be placed against a flat surface. The base includes a lip configured to engage and support a magazine in an upstanding manner thereon. The base also includes a hydraulic shaft having a first end and a second end, wherein the first end is affixed to the base. The second end includes a depressible platform and a projection, wherein the depressible platform is configured to be hand actuated downwardly in relation to the hydraulic shaft. In this way, the projection is configured to apply downward pressure against an unloaded cartridge so that it can be loaded into the magazine. The projection includes a pointed end and an angled extension, which is configured to be placed flush against a cartridge to prevent tilting and improper loading of the cartridge into the magazine.

It is therefore submitted that the present invention is substantially divergent in design elements from the prior art, and consequently it is clear that there is a need in the art for an improvement to magazine loaders. In this regard, the instant invention substantially fulfills these needs.

SUMMARY OF THE INVENTION

In view of the foregoing disadvantages inherent in the known types of magazine loaders now present in the prior art, the present invention provides a magazine loader, wherein the same can be utilized for providing convenience for the user when loading a plurality of cartridges into the magazine of a firearm.

It is therefore an object of the present invention to provide a new and improved magazine loader that has all of the advantages of the prior art and none of the disadvantages.

Another object of the present invention is to provide a new and improved magazine loader comprising a base having a lip configured to support a magazine in an upright position.

Yet another object of the present invention is to provide a new and improved magazine loader further comprising a hydraulic shaft affixed to the base, wherein the magazine is adapted to be positioned parallel to the hydraulic shaft.

Still yet another object of the present invention is to provide a new and improved magazine loader, wherein the hydraulic shaft includes a second end having a depressible platform and a projection configured to be hand actuated downwardly in relation to the hydraulic shaft.

A further object of the present invention is to provide a new and improved magazine loader, wherein the projection includes a pointed end and an angled extension configured to be placed flush against an unloaded cartridge, wherein the projection is forced downwardly to load the cartridge into the magazine.

Still yet another object of the present invention is to provide a new and improved magazine loader wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
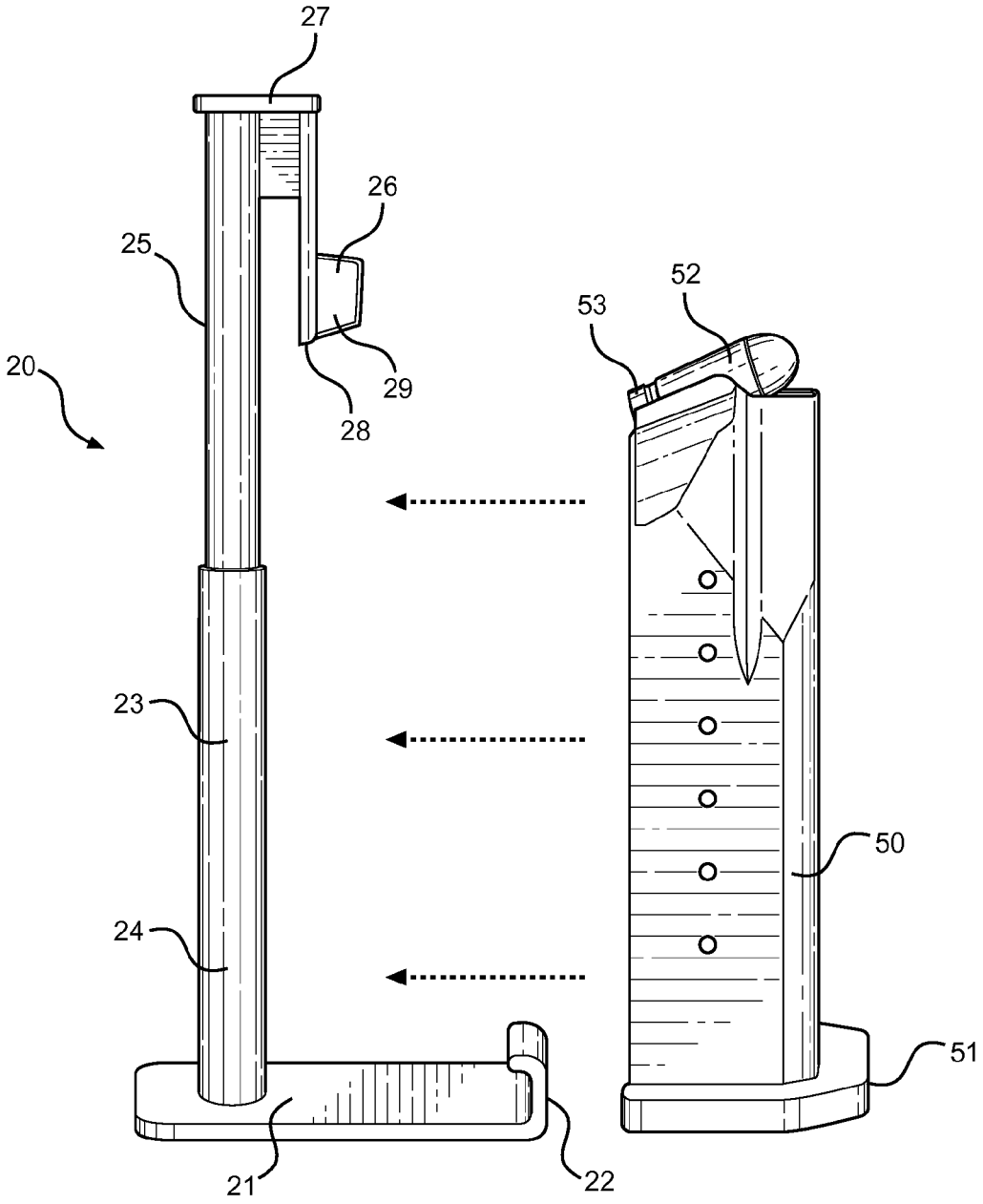
FIG. 1 shows a side perspective of the magazine loader.

Reference is made herein to the attached drawings. Like reference numerals are used throughout the drawings to depict like or similar elements of the magazine loader. For the purposes of presenting a brief and clear description of the present invention, the preferred embodiment will be discussed as used for facilitating loading of cartridges into a magazine. The figures are intended for representative purposes only and should not be considered to be limiting in any respect.

Figure 2:
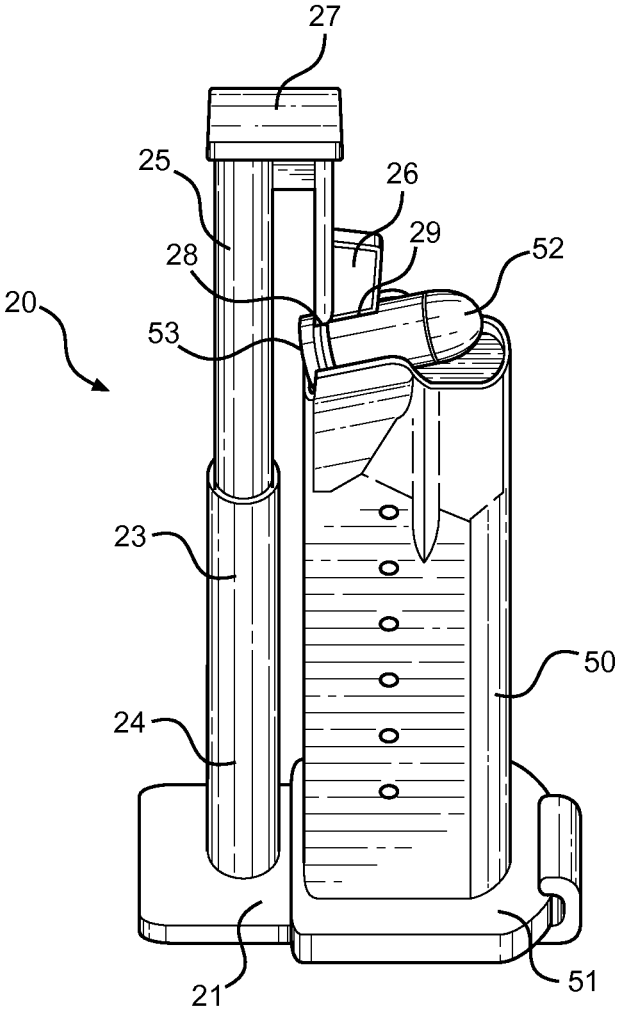
FIG. 2 shows an side perspective of the magazine loader in a resting configuration.

Referring now to FIGS. 1 and 2, there are shown views of the magazine loader of the present invention. The magazine loader 20 is configured to facilitate loading of cartridges into a magazine of a firearm. Such firearms include magazine holders for Smith & Wesson pistols and revolvers, however, other types, sizes and shapes of magazines are likewise contemplated. The magazine loader 20 includes a base 21 that is configured to be placed flush against a flat surface. Preferably, the base 21 is rectangular in shape, however, other sizes and shapes are alternatively used in other embodiments.

The base 21 is also configured to support an upstanding magazine 50 thereon. The base 21 includes a lip 22 configured to removably engage a lower edge 51 of a magazine 50 in order to allow the magazine 50 to be maintained in an upright orientation. Preferably, the lip 22 is substantially curved in a U-shape in relation to the base 21 in order to removably support the magazine 50 in an upstanding position. As illustrated, the lower edge 51 of the magazine 50 includes a base bumper, wherein the lip 22 is configured to engage therewith. Other shapes and sizes of the lip 22 are alternatively used in other embodiments, and likewise contemplated.

An elongated hydraulic shaft 23 extends upwardly and perpendicularly from the base 21. The magazine 50 is configured to be supported on the base 21 in a parallel and upstanding manner in relation to the elongated hydraulic shaft 23. The hydraulic shaft 23 includes a first end 24 and a second end 25, wherein the first end 24 is affixed to the base 21. The second end 25 is configured to make contact with an unloaded cartridge 52 that is placed above an opening of the magazine 50 in order to be loaded into the magazine 50 attached to the base 21.

The second end 25 includes a depressible platform 27. The depressible platform 27 is configured to be manually actuated downwardly to apply downward pressure on a projection 26 in order to load a cartridge 52 into the magazine 50. When loading, the projection 26 is placed in contact with the cartridge 52, wherein the hydraulic shaft 23 allows for the depressible platform 27 and the projection 26 to be further forced downwardly through the opening of the magazine 50 to load the cartridge 52 into the magazine 50. The second end 25 and the projection 26 preferably form a substantially U-shape in relation to one another. The hydraulic shaft 23 is configured to return to its original position after hand actuation. This is particularly advantageous as it allows for the magazine loader 20 to subsequently load additional cartridges 52 until the magazine 50 is fully loaded. The platform is preferably rectangular in shape, however, other sizes and shapes are likewise contemplated.

As illustrated, the second end 25 and the projection 26 are configured to be positioned above a magazine 50 when it is being loaded. The projection 26 comprises a pointed end 28 and an angled extension 29, wherein the pointed end 28 is configured to engage with the extractor rim 53 of the cartridge 52. The angled extension 29 is disposed at an angle in relation to the projection 26. The angle is preferably substantially equal to the angle at which a cartridge 52 is loaded into a magazine 50, whereby the angled extension 29 is placed flush against the body of the cartridge 52.

It is not desired for this present disclosure to limit the exact angle of the angled extension 29, rather it is desired to disclose and claim an angled extension for obtaining the results and the advantages described herein. It is contemplated that those of ordinary skill in the art can readily identify other preferable angles for the angled extension 29 to load a cartridge 52 into the magazine 50. These variations and modifications are deemed to be within the scope of the inventive embodiments described herein.

Figure 3:
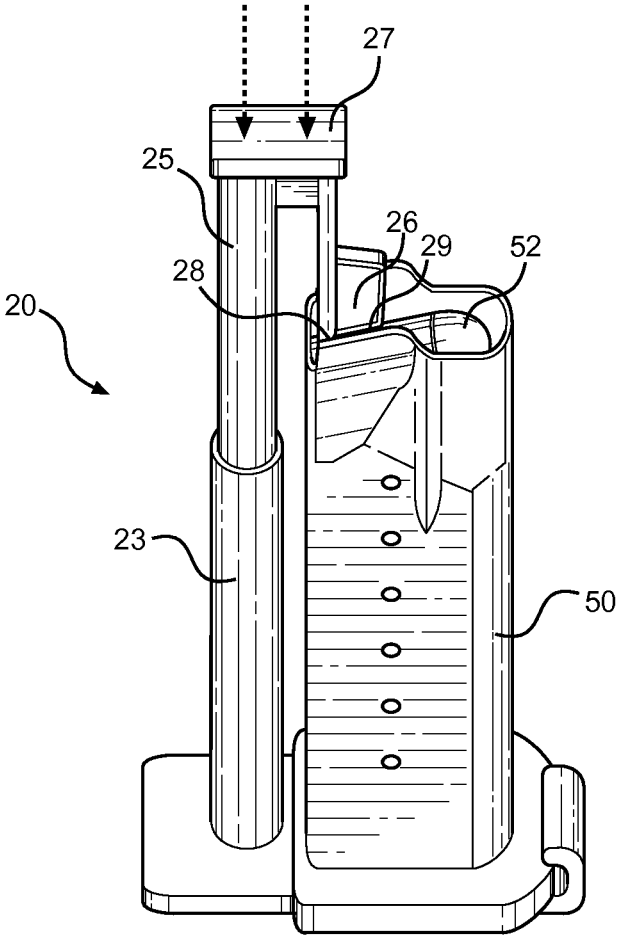
FIG. 3 shows a side perspective of the magazine loader in a depressed configuration.

Referring now to FIG. 3, there is shown a side perspective of the magazine loader loading a cartridge into the magazine. The second end 25 of the hydraulic shaft 23 is configured to be placed in contact with the cartridge 52 to be loaded into the magazine 50. The second end 25 includes the depressible platform 27 and the projection 26. The depressible platform 27 is configured to be hand actuated downwardly in relation to the hydraulic shaft 23, thereby downwardly moving the projection 26 and applying downward pressure to an unloaded cartridge 52.

The projection 26 includes a pointed end 28 and an angled extension 29 configured to be placed flush against an unloaded cartridge 52 that rests on the magazine 50. In this particular engagement, the cartridge 52 is prevented from tilting and loading improperly into the magazine 50 and the angled extension 52 ensures that the cartridge 52 is loaded correctly into the magazine 50. The hydraulic shaft 23 allows for the depressible platform 27 and the projection 26 to retract back upwardly to allow for additional cartridges 52 to be loaded.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A magazine loading device, comprising:

a base adapted to support a magazine in an upstanding position thereon;

a hydraulic shaft having a first end and a second end, wherein said first end is affixed to said base;

said second end having a depressible platform and a projection;

wherein said depressible platform is configured to be manually actuated downwardly to force said projection downwardly to engage and load a cartridge into an upper end of said magazine on said base.

2. The magazine loader of claim 1, wherein said projection comprises a pointed end and an angled extension, wherein said pointed end and said angled extension are configured to be placed flush against said cartridge to load said cartridge into said magazine.

3. The magazine loader of claim 1, further comprising a lip disposed on said base adapted to removably engage with a lower end of said magazine so as to secure said magazine in position on said base.

4. The magazine loader of claim 3, wherein said lip is substantially U-shaped.

5. The magazine loader of claim 1, wherein said hydraulic shaft is telescopic.

6. The magazine loader of claim 1, wherein said depressible platform is movable between a resting configuration and a depressed configuration, wherein said depressible platform is adapted to automatically return to said resting configuration once moved into said depressed configuration.

* * * * *